United States Patent [19]

Pichl

[11] 4,403,969

[45] Sep. 13, 1983

[54] OUTBOARD DRIVE

[75] Inventor: Heinz Pichl, Uppsala, Sweden

[73] Assignee: AB Volvo Penta, Gothenburg, Sweden

[21] Appl. No.: 236,208

[22] Filed: Feb. 20, 1981

[30] Foreign Application Priority Data

Feb. 21, 1980 [SE] Sweden ..... 8001353
May 27, 1980 [SE] Sweden ..... 8003906

[51] Int. Cl.[3] ..... B63H 5/12

[52] U.S. Cl. ..... 440/56; 440/59; 440/61; 248/642

[58] Field of Search ..... 440/53–65; 248/640–642

[56] References Cited

U.S. PATENT DOCUMENTS

| | | | |
|---|---|---|---|
| 3,016,869 | 1/1962 | Anderson et al. | 440/56 |
| 3,434,449 | 3/1969 | North | 440/57 |
| 3,653,270 | 4/1972 | Bergstedt | 440/59 |
| 4,119,054 | 10/1978 | Pichl | 440/61 |

FOREIGN PATENT DOCUMENTS

| | | | |
|---|---|---|---|
| 303696 | 9/1968 | Sweden | 440/59 |

*Primary Examiner*—Trygve M. Blix
*Assistant Examiner*—Stephen P. Avila
*Attorney, Agent, or Firm*—Arthur G. Yeager

[57] ABSTRACT

A trim and tilt arrangement for an outboard drive includes an elongated support pivoted at their forward ends on the lower part of the rudder post and at their rearward ends interconnected by a connection which with the aid of elongated slots in both side walls of the outboard drive casing passes therethrough. An engagement in the outboard drive engages from behind the connecting means. Trim and/or tilt motion is achieved by either varying the length of the supporting means, or the relative position of the engagement means with respect to the outboard drive and this is accomplished from a remote-control station to the driver. The engagement is releasably secured to the connection by specially adapted locking devices which release in response to lower rearward force in forward drive and higher force in reverse drive.

38 Claims, 16 Drawing Figures

G
12
13
34
44
30A
40
14c
18
101
26a
102
105
40A
16
35
38
G
26b
24A
25
24A''
24a
40B
42
41
35'
37
11
24a
36

OUTBOARD DRIVE

The invention relates to an outboard drive, i.e., either an outboard motor, or the outboard located part of an inboard/outboard motor, or the so-called Z-drive.

It is known to use as shown in U.S. Pat. No. 4,086,869 dated May 2, 1978 to Woodruff, for trimming and tilting such outboard drives by remote control from the driver's station, hydraulic cylinder-piston assemblies mounted outside of the casing of the outboard drive, and affecting the outboard drive at a point which does not change place. The purpose of the present invention is to solve in a novel and advantageous manner the problem of the remotely controlled, motor-driven trimming and tilting of an outboard drive, particularly with a view to simplified construction and protection of the movable parts against the environmental effects.

The invention is characterized by the distinctive features set out in the attached claims. Terms such as "forward", "from the front" and "backward", "from the rear" etc. refer in the present specification and in the patent claims always to the normal direction of travel of the boat.

Figure 1:
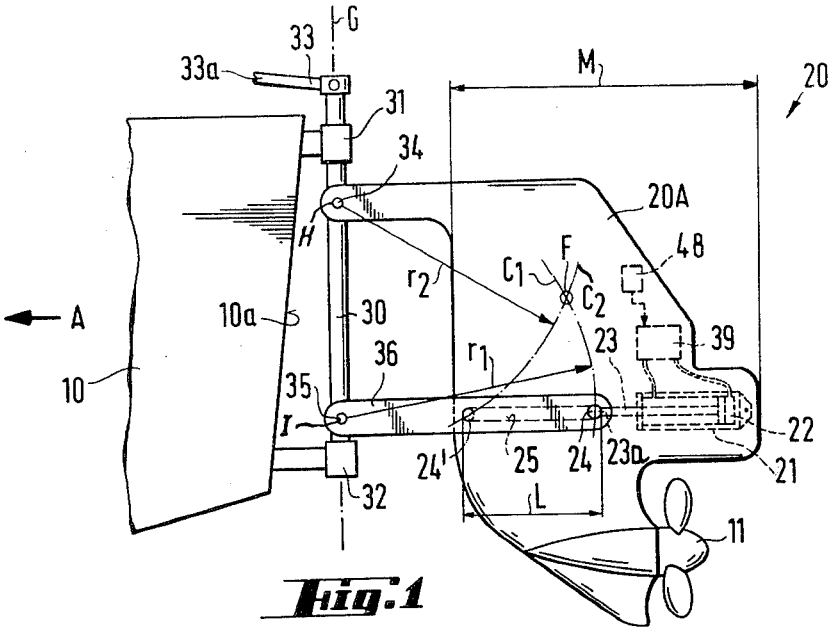
Figure 2:
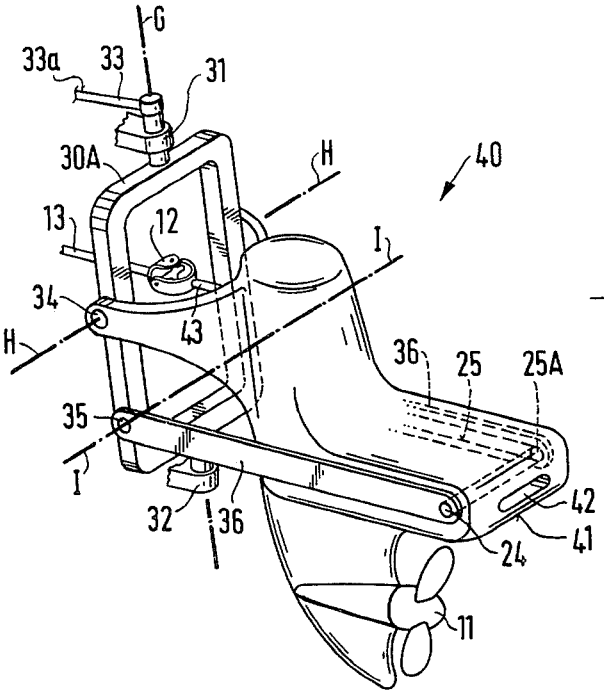
Figure 3:
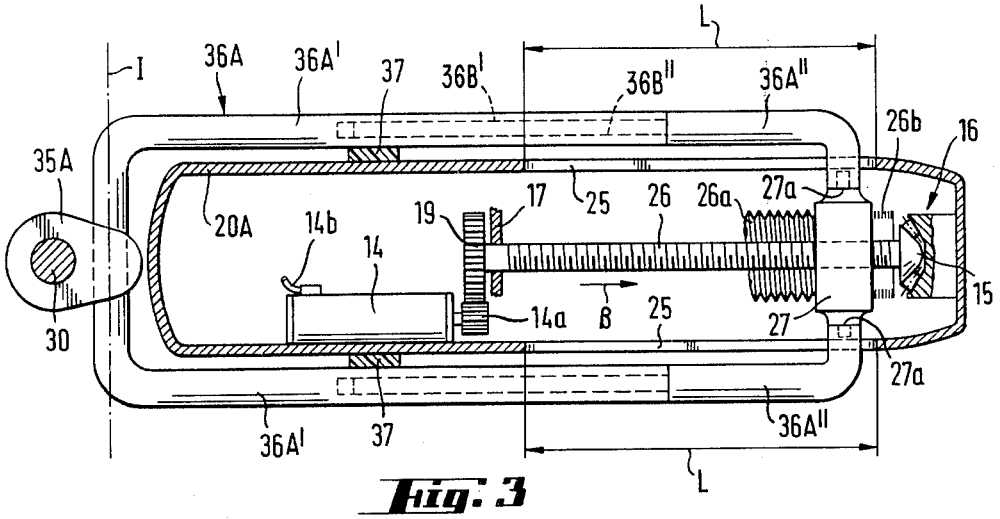
Figure 6:
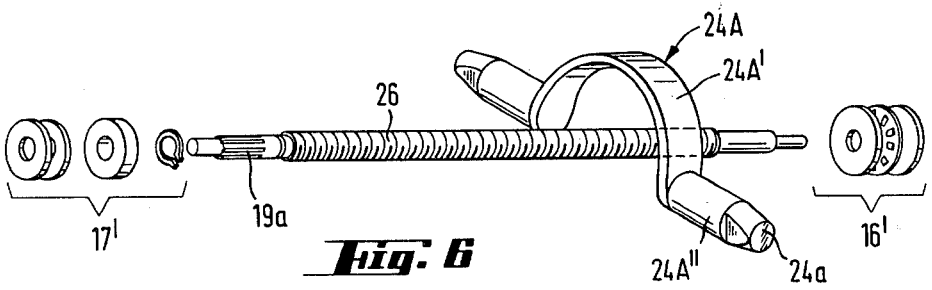
Figure 7:
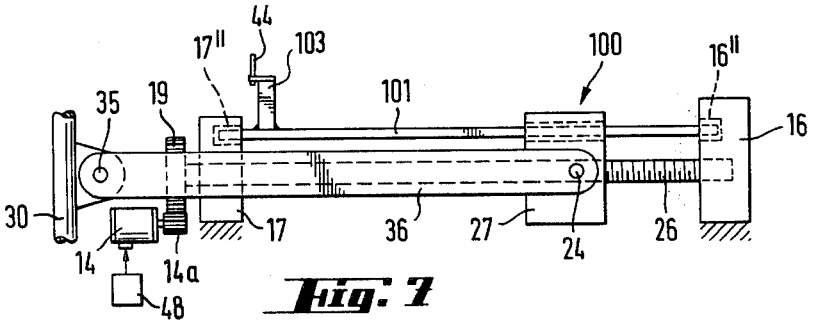
Figure 4:
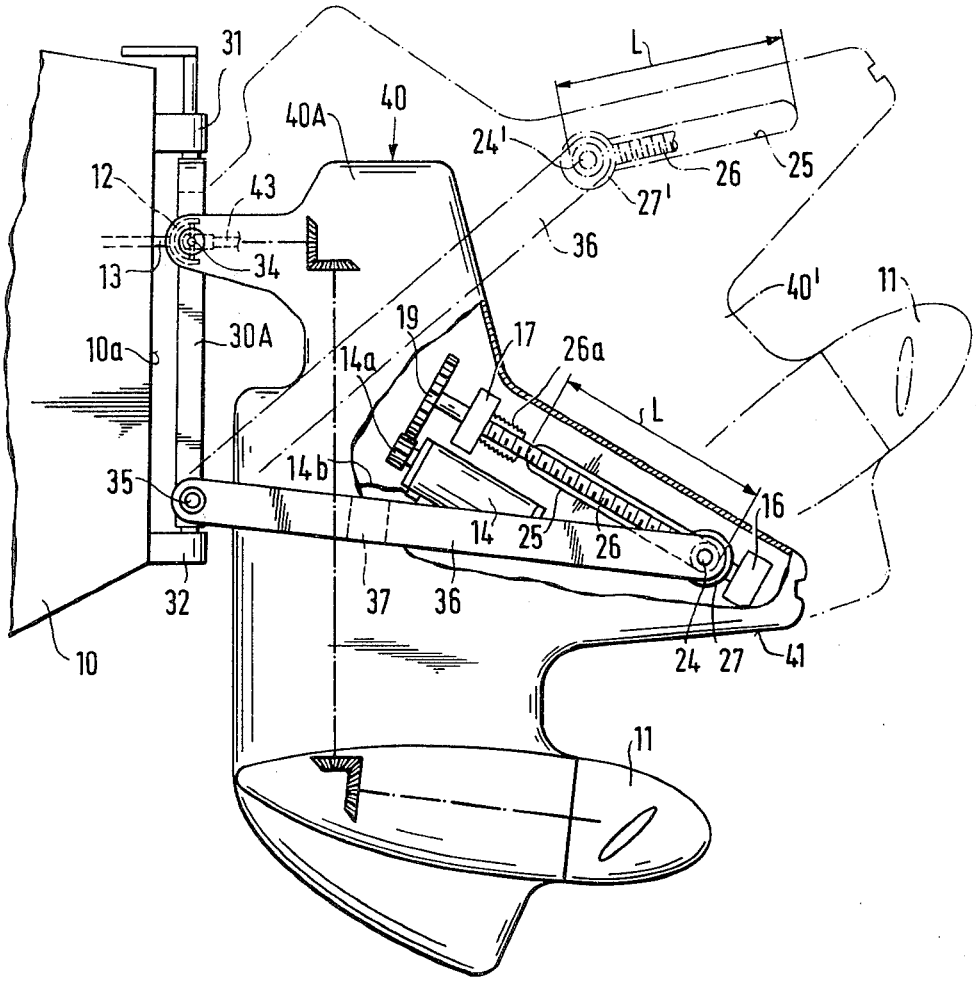
Figure 5:
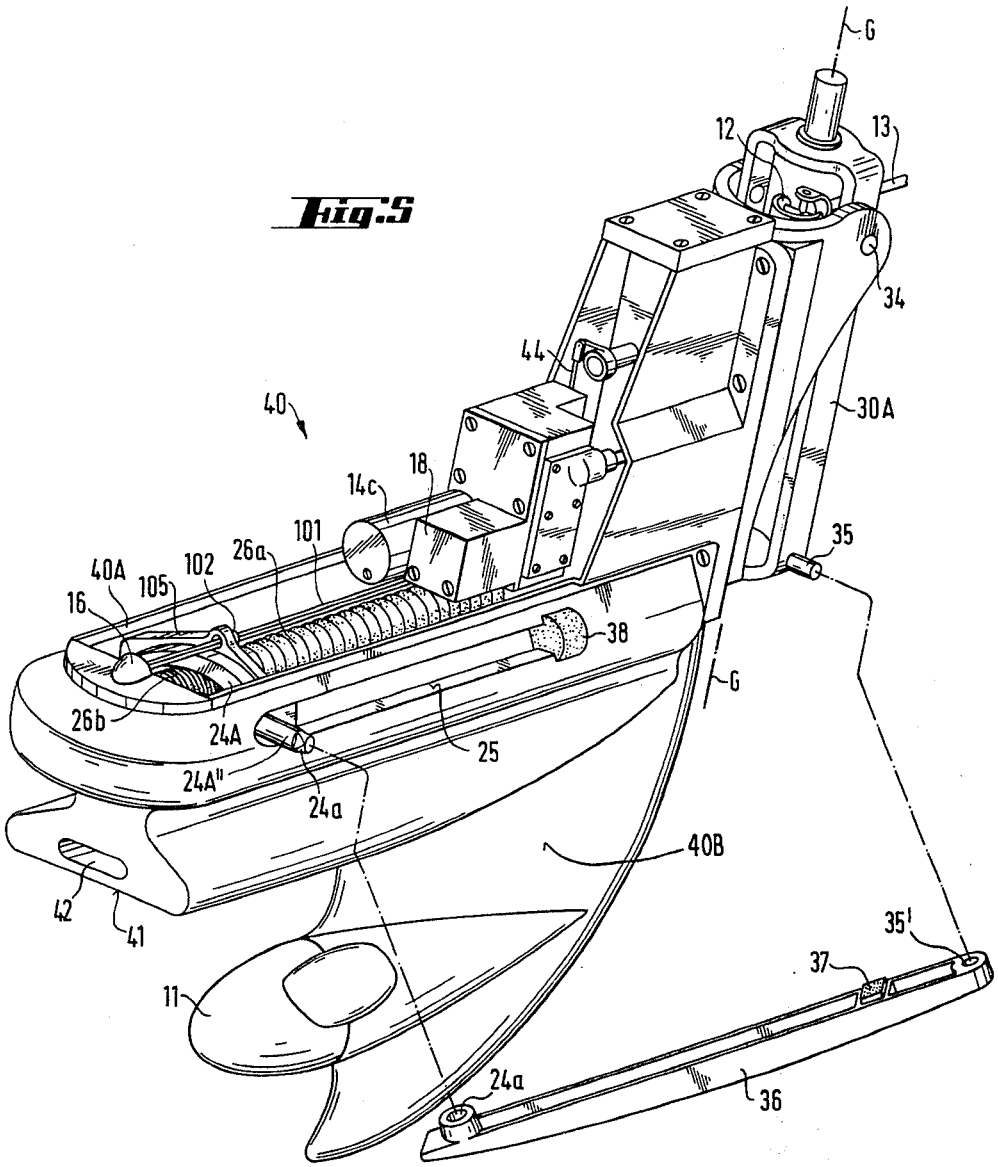
Figure 8:
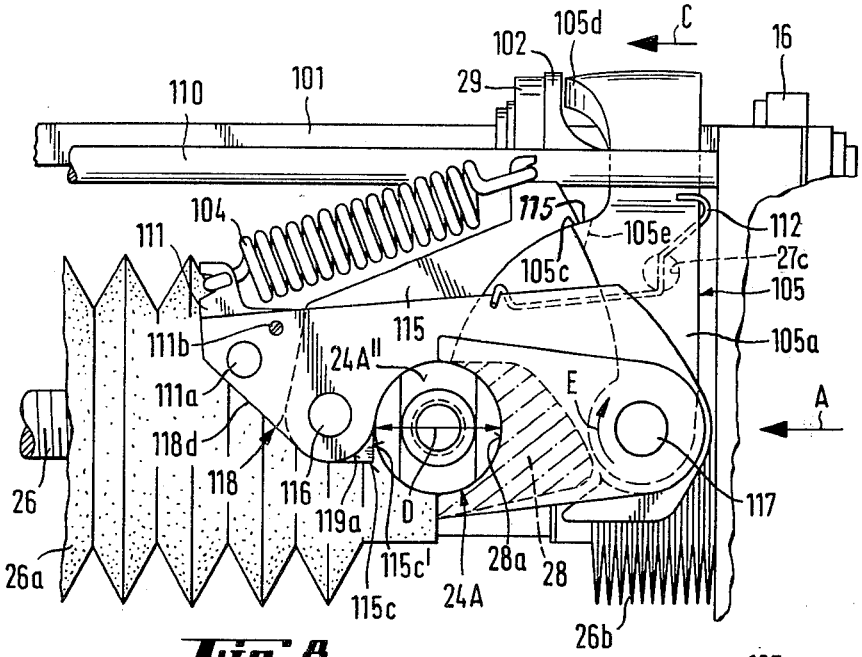
Figure 9:
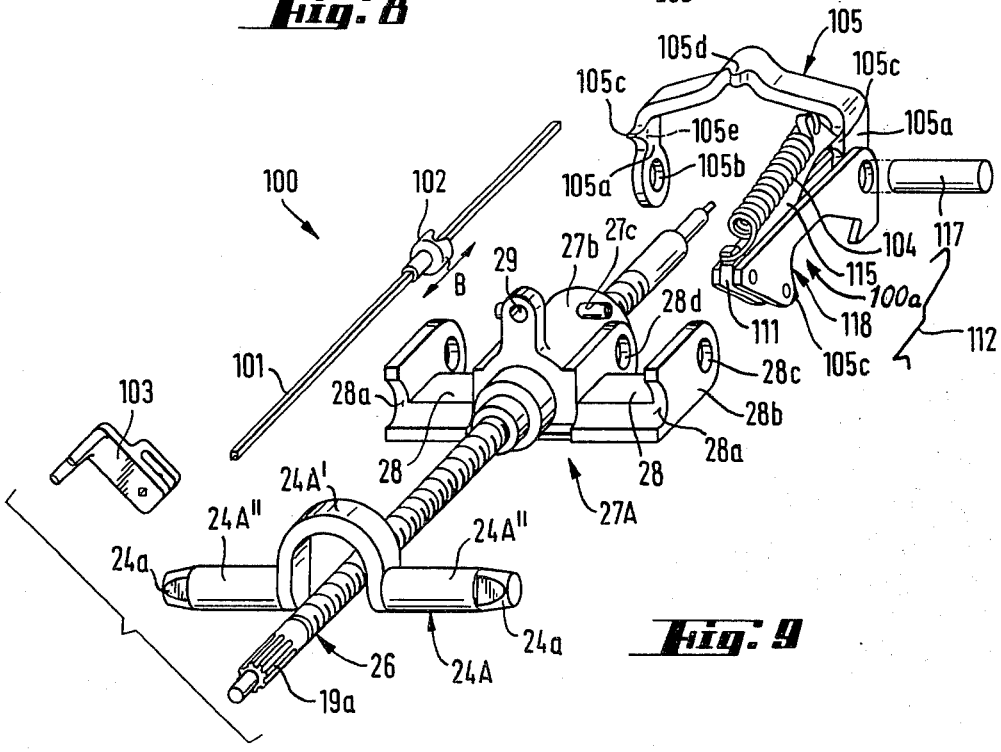
Figure 10:
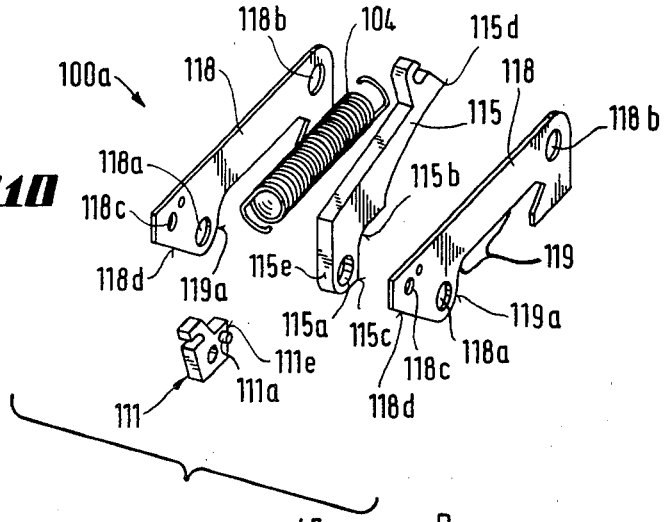
Figure 14:
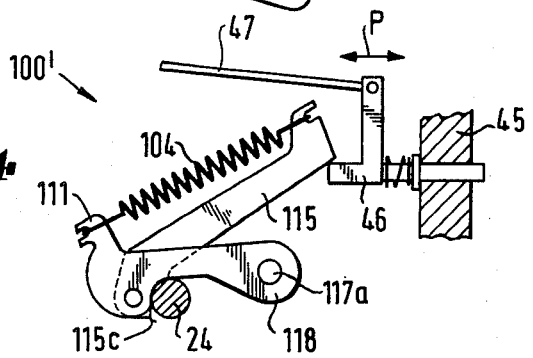
Figure 15:
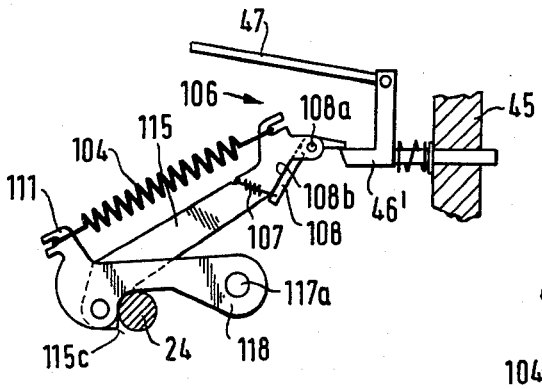
Figure 16:
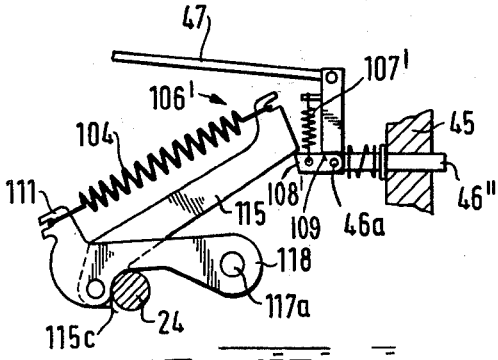
Figure 11:
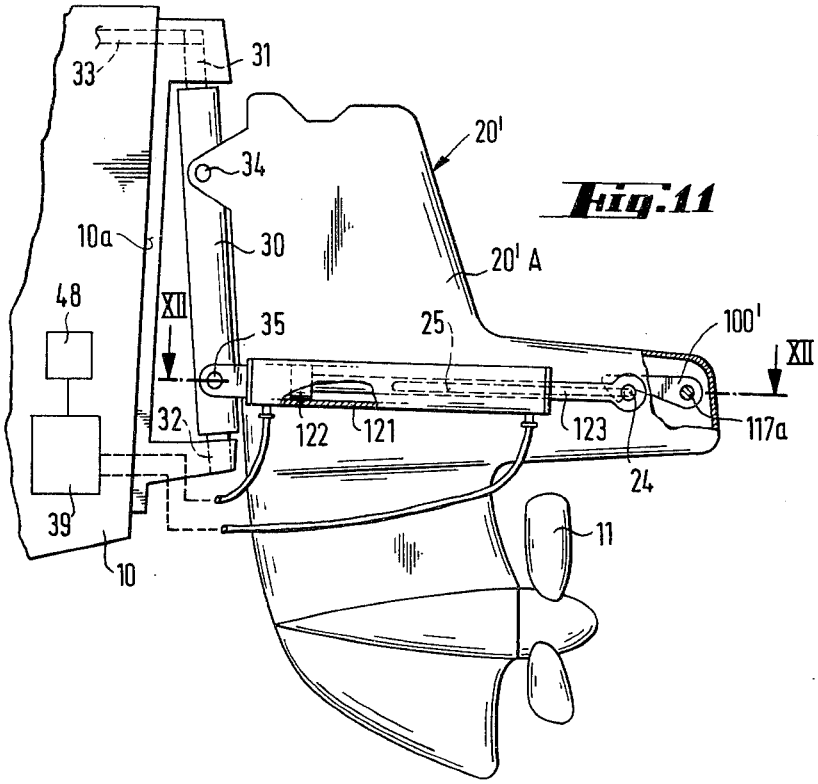
Figure 12:
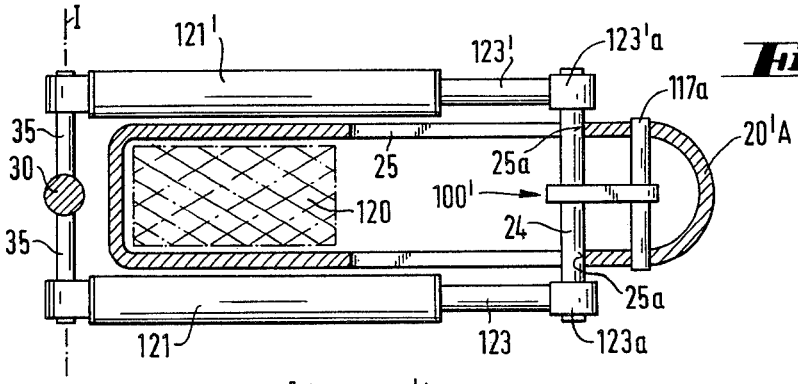
Figure 13:
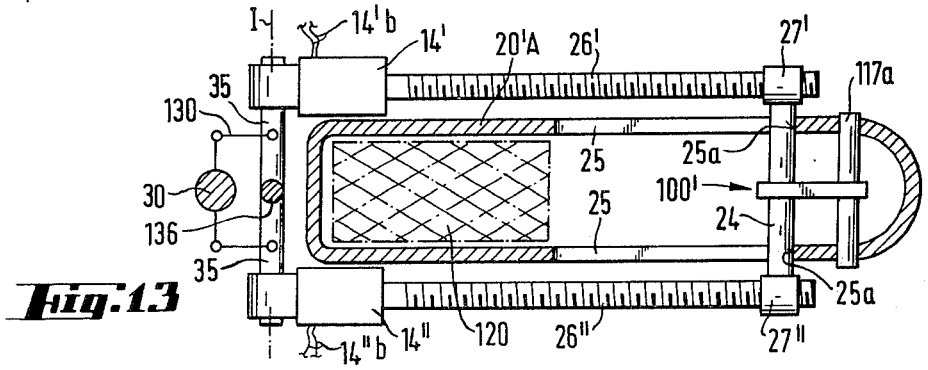

The invention will now be explained more in detail with reference to the enclosed schematical drawings which represent exemplary embodiments and in which:

FIG. 1 is a side-elevation of a modified outboard motor according to the invention, FIG. 2 is a perspective view of the outboard part of an inboard/outboard motor according to the invention, FIG. 3 is a longitudinal sectional view of another embodiment of the drive similar to FIG. 2, FIG. 4 shows in side-elevation, partly in cross-section, of another embodiment of the drive according to FIG. 2, FIG. 5 shows in a rear perspective view a further embodiment of an outboard drive according to the invention, with cover removed, FIG. 6 is an exploded view of a screw spindle according to the invention with appertaining bearings and connecting yoke, FIG. 7 is a side-elevation of a screw spindle according to the invention, provided with a locking device, FIG. 8 shows such a locking-device of FIG. 7 in enlarged scale and in more detail, FIG. 9 is an exploded perspective view of the locking-device of FIG. 8, FIG. 10 is an exploded view of a detail portion of the locking-device of FIG. 9, FIG. 11 is a side-elevation, similar to that of FIG. 1, of another outboard motor according to the invention, FIG. 12 is a longitudinal sectional view along the plane XII—XII in FIG. 11, FIG. 13 is a longitudinal sectional view, similar to FIG. 12, of a still further embodiment of an outboard motor according to the invention and FIGS. 14 to 16 are side elevations of three different embodiments of the locking-device in the arrangements according to FIGS. 11 to 13. Like reference numerals designate functionally corresponding parts throughout the several figures of the drawing and in the description of subsequent figures reference is made to prior description of such parts.

According to FIG. 1, a lateral steering axle means in the form of a rudder post 30 pivots about the vertically extending lateral steering axis G and is mounted on the transom 10*a* of a boat 10 in two spaced bearings 31, 32, arranged vertically in alignment one above the other. Rigidly attached to the upper end of the steering post 30 is a tiller 33, the forward end 33*a* of which is coupled to a known remote-control mechanism, not shown, at a driver's place.

An outboard motor 20 with a casing 20A and a propeller 11 is suspended on steering post 30 in such a way that it can be tilted up about the horizontal axis H (FIG. 2) of a first journal 34. Journal 34 defines a tilt axle means for the outboard motor. The above steering axle or pivot means and tilt axle or pivot means provides mounting means for mounting casing 20A on boat 10 for steering movement and tilt movement between drive trim position and tilt positions. Linkage means, connected between this mounting means and casing 20A for controlled positioning of casing 20A in such positions, is now described. Two elongated rigid support arms 36 with unvariable length are arranged, one on either side of steering post 30 and of casing 20A, to pivot with their forward ends on a second journal 35, defining a hinge axle means having hinged axis I and located spacedly below the first journal 34 on steering post 30.

In each side wall of casing 20A there is provided an elongated straight slot 25, having a length L, which extends, when the outboard motor is in its normal driving position, at least approximately in the direction of travel. The support arms 36 are at their rear ends connected one with the other by a connecting means in the form of a straight connecting rod 24 passing via both slots 25 right through the casing 20A. Connecting rod 24 has such diameter that it freely can move and be guided in the slots 25 in their longitudinal direction. Thus slots 25 provide, for example, guide means on casing 20A for the connecting means or rod 24.

Connecting rod 24 engages in the casing 20A with a fork or open eye 23*a* mounted on the end of a piston rod 23 associated to a piston 22 in a hydraulic cylinder-piston assembly which further comprises a cylinder 21 stationarily mounted in the outboard motor 20. The open eye 23*a* defines an engagement means for the connecting rod 24 and is constantly pressed against this rod by the effect of the resistance produced when the forward propulsion force of the propeller 11 drives the boat in forward direction in the sense of arrow A. This engagement means, open eye 23*a*, and cylinder piston assembly 21 to 23, a positioning means, provide mechanical means for connecting casing 20A to connecting rod 24. The cylinder-piston assembly 21 to 23 is supplied from a source 39 of pressurized fluid. Source 39 is operated by an operating means 48 which in turn is remotely-controlled from the driver's place, in a manner not shown in the drawing.

When piston 22, after having been activated with the aid of operating means 48, is moved forwardly in the cylinder 21 in the sense of arrow A, the connecting rod 24 is moved forwardly in the slots 25 relative to the outboard motor 20 (but not relative to the support arms 36) to a desired position, possibly up to the forward limit position 24'. As connecting rod 34 is mounted on the support arms 36 at unvariable distance from the hinge axle means 35, the displacement of the point of application of the connecting rod on the outboard motor 20 results in the outboard motor being tilted upward, the support arms 36 rotating and connecting rod 24 effectuating a circular tilting motion from drive to tilt position along the circle $C_1$ with its centre in the second journal 35 and of radius $r_1$, corresponding to the unvariable effective length of the support arm 36. Thus cylinder piston assembly 21–23 provides positioning means for positioning outboard motor 20 and casing 20A.

The final position of connecting rod 24 relative to the boat 10 is determined by the point of intersection of circle $C_1$ with a second circle $C_2$ centred on the first journal 34, and having a radius $r_2$ corresponding to the distance between the connecting rod 24 in its final position and the first journal 34. In the example shown, this final position is at F, where the connecting rod 24 in limit position 24' in slots 25 in fact is located when motor 20 has been completely tilted up. Thus, to raise the motor, the connecting rod 24 is moved forwardly in the elongated slots 25 closer to the transom 10*a*.

It is evident from the drawing FIG. 1 that, for each intermediate position of connecting rod 24, a circle analogous to $C_2$ can be drawn, which will intersect circle $C_1$ closer to the lowest position of support arm 36 than the extreme circle $C_2$ shown in the drawing does whereby the outboard motor can be tilted up to any required position between the position shown and the position in which the slots 25 pass through point F. By means of small movements of this kind it is thus possible to adjust the trim of the motor, i.e. to set the propeller shaft angle, and the largest tilting movement raises motor 20 completely clear of the water, or mooring, for example (known as tipping).

As is known, it must be also possible for an outboard motor and the outboard part of an inboard/outboard motor to swing up freely or unaidedly when the boat is moving forward and such outboard motor or part strikes an underwater obstacle. Such unaided tilting up is achieved by attaching connecting rod 24 to piston rod 23 by means of such eye 23*a* which is open towards the front and thus allows connecting rod 24 to be moved in the slots 25 even when eye 23*a* does not follow, since its position is set by cylinder-piston assembly 21 to 23. In FIG. 1, the linkage means has support means or support arms 36 pivotally mounted by hinge means or journal 35 to the mounting means and by connecting means or connecting rod 23 slidable in guide means or slots 23 to casing 20A and mechanical means having positioning means or cylinder piston assembly 21 to 23 for connecting the connecting means to said casing 20A for providing the above described control of tilt movement.

In FIG. 2, in which components with the same function as in FIG. 1 are given identical reference numerals, is schematically shown the application of the present invention in an inboard/outboard motor, or, more precisely, in the outboard part 40 thereof. The outboard part 40 is carried by means of journals 34 on a one-piece rigid suspension frame 30A which in turn pivots in two bearings 31, 32 fixed to the transom of a boat in a manner analogous to the the steering post 30 in FIG. 1. The suspension frame 30A defines the rudder post of the lateral steering axle means having a vertically extending lateral steering axis G, and the journals 34 define, as before, tilt axis means with a horizontally extending tilt axis H.

The drive and control function lines to the outboard part 40 pass from an inboard driving unit, not shown in FIG. 2, through the central space of frame 30A and through an opening, not shown, in the transom (10*a* in FIG. 1) of the boat. The outboard part 40 and the support arms 36 may also, and preferably, be attached to the suspension frame 30A on the inside thereof, as shown in FIG. 4. For simplicity the drawing shows only the transmission of the torque from the output shaft 13 of the driving unit via a double universal joint 12 to the input shaft 43 of the outboard part 40.

It will be understood from the study of FIG. 1 that the use of a cylinder-piston assembly to displace the connecting rod 24 requires a fairly large longitudinal dimension M (FIG. 1), since the cylinder 21 must be long enough to enable piston 22 to perform a stroke equal to L, approximately half of the length M being behind the rear end of slots 25.

FIG. 2 shows however that the rear ends of the slots 25 (FIG. 5) where connecting rod 24 is shown to be situated in FIG. 2, are located practically at the rear end of the casing of outboard part 40, where an anticavitation plate 41 is terminated with an exhaust outlet 42. To alleviate the problem of such a large longitudinal dimension M, it is preferred, in accordance with an alternative embodiment of the present invention, that the connecting means be moved in the slots 25 by a nut and screw assembly, such as shown in FIG. 3, for example, which does not require a design with twice its length to operate, as in the case of a cylinder-piston assembly described in FIG. 1.

FIG. 3 shows in detail the design of such a nut and screw assembly providing the positioning means in the mechanical means of the linkage means in an outboard motor similar to the motor shown in FIGS. 1 and 2. In the casing or motor housing 20A, a screw spindle 26 is rotationally mounted with the aid of a thrust cover 15 in a rear thrust bearing 16, and a front radial bearing 17. The bearings 16, 17 are fixedly mounted in the casing 20A. A first pinion 19 is rigidly mounted on the forward end of the screw spindle 26. A reversible electric motor 14 with a second pinion 14*a* is also mounted in motor casing 20A. Pinions 14*a* and 19 mesh one with the other and electric motor 14 is remotely controlled via electrical leads 14*b* from the driver's place in the boat.

The two support arms 36 of FIG. 1 are in FIG. 3 merged into an elongated rectangular support frame 36A, and they form the two long sides of this support means. The front short side of support frame 36A defines the hinge axle means and pivots in a bearing 35A which is rigidly fixed to steering post 30.

The rear short side of support frame 36A provides connecting means and is split up and at pivot points 27*a* attached to a nut 27 screwed on the screw spindle 26. By its connection to support frame 36A, nut 27 is prevented from rotation on screw spindle 26.

Along the length L are slots 25, through which the rear short side of supporting frame 36A passes, arranged in motor housing or casing 20A. Screw spindle 26 is, in the example shown, situated in the same plane as support frame 36A (i.e. in the drawing plane of FIG. 3). Protecting and sealing bellows 26*a*, 26*b*, of rubber for example, only partly shown in the drawing, extend in axial direction on both sides of nut 27. To provide the engagement means to enable the unaided tilting motion mentioned in connection with FIG. 1, when the outboard motor strikes an underwater obstacle, the long sides of the support frame 36A are made telescopic, so that their rear portions 36A'' freely can be drawn out from the tubular front portions 36A'. It will be appreciated that such telescopic construction of the engagement means on the support means provides a support means that has unvariable length in response to forward force under normal forward drive motion of the boat. Portions 36A'' include forward extensions 36B'' which freely telescopically slide within hollows 36B' is portions 36A'.

Pressure-absorbing buffers 37, of rubber for example, are provided between the long sides of frame 36*a* and motor casing 20A, especially to take up the lateral forces on steering to the side, and/or for general shock absorption purposes.

When electric motor 14 rotates in one of its directions of rotation, screw spindle 26 is screwed into nut 27 in the direction of arrow B and thrust bearing 16, fixed in motor casing 20A, is forced backwards (to the right in the drawing). Because of the specific suspension arrangement shown in FIG. 1, this results in lifting of the outboard motor 20. When electric motor 14 rotates in the opposite direction, the screw spindle 26 is screwed out of nut 27 in the opposite direction to arrow B, and the outboard motor is lowered, partly under its own weight.

FIG. 4 shows an alternative arrangement of screw spindle 26 of FIG. 3 in the outboard part 40 of an inboard/outboard motor similar to that of FIG. 3. In this case, the screw spindle and slots 25 are not situated in the same plane as support arms 36, but subtend or form a sharp angle with the rear portions of said arms when said connecting rod 24 is at the rear end of slots 25 or in rear limit position. The present invention builds on the principle that the point of attack of the pivotable support means on the tiltable casing is displaceable between a rear position and a forward position which is closer to the hinge means on which the support means are pivoted. The tilted-up position 40' of the outboard part, on completion of such a forward movement of the connecting means, is shown with dashed lines in FIG. 4.

It will be noted that the arrangement of electric motor 14 alongside and parallel to screw spindle 26, as shown in FIG. 4, does not require any increase in the length dimension L of the device.

In FIG. 5 is shown an alternative embodiment of the outboard part 40 of an inboard/outboard motor with a cover portion of the casing 40A removed and with one of the support arms 36 (FIG. 1) shown disassembled. The connecting means defined by a yoke 29A co-operates with a releasable locking device shown in more detail in FIGS. 8 to 10. From FIG. 5 it is evident that screw spindle 26 (FIG. 3) is completely enclosed in its front and rear protective bellows 26*a*, 26*b*. Electric motor 14 (FIG. 3) is located in a housing 14*c*, and a reduction gear unit, not shown, is provided between its output shaft and the screw spindle 26 (FIGS. 6–9). A housing 18 alongside the motor housing 14*c* contains electronic components, particularly relays and limit switches for the electric motor, and one or more potentiometers serving various indicating devices such as instruments or lamps mounted at the driver's place.

Shock-absorbing stops, for example rubber buffers 38, are arranged at the forward end of slots 25 to receive lateral portions 24A of the connecting means 24A, especially when part 40 is suddenly tilted up on striking an underwater obstacle. The buffers 38 may be attached either to the outboard part 40 or each to one support arm 36.

Support arm 36 in the form of an elongated hollow section is provided with an opening 35' for journal 35 and an attachment 24*a* for the connecting means 24A. Buffers 37 according to FIG. 3 (for absorbing lateral forces), as well as stop buffers 38, recently mentioned, may be located inside such a hollow arm 36.

FIG. 5 shows the following parts, guide bar 101, cam element 102, cam yoke 105 and linkage 44, of the locking device 100 described below with reference to FIGS. 7–10. From FIG. 5 is evident that the lateral steering axis G can in the construction according to the invention pass very closely to the front edge of a side-stabilizer face 40 B (so called) "lateral"), with the result that less power is needed for lateral steering.

FIG. 6 shows, as used in FIG. 5 a preferred alternative embodiment of screw spindle 26 with splines 19*a* for pinion 19 (FIGS. 3 and 4) and with modified thrust and radial bearings 16', 17', by means of which screw spindle 26 is mounted in outboard part 40 or in outboard motor 20. The connecting means, also shown in FIG. 5, has the form of a rigid connecting yoke 24A which with an arch-shaped central portion 24A' straddles screw spindle 26 or, for that matter, any other object similarly located in the casing of an outboard drive. Later on (FIGS. 8 and 9), it will be described more in detail how connecting yoke 24A with the aid of laterally protruding portions 24A" can be releasably attached to nut 27 which thereby is prevented from rotating.

FIG. 7 shows in a diagrammatic side elevation an alternative embodiment of the arrangement according to FIG. 3 and used in the outboard drive of FIG. 5. Nut 27 is screwed onto screw spindle 26 which is mounted in rear thrust bearing 16 and front radial bearing 17 both mounted on the casing. The front end of the screw spindle 26 is fitted with pinion 19 to be driven by electric motor 14. The two rigid support arms 36 (one on either side of the screw spindle) pivot with the aid of journals 35 on steering post 30. By means of a connecting means 24 including locking device 100, each support arm 36 pivots on nut 27. The design and operation of the connecting means and locking device will be described later in greater detail with the aid of FIGS. 8 to 10. A guide bar 101 is carried above screw spindle 26 in bearings 16", 17", in which it is free to rotate, but cannot be displaced axially. Guide bar 101 is at its front end fitted with a latch fork 103, and interacts with nut 27 in a manner which will also be described later.

According to FIGS. 8 to 10, nut 27A has two wings 28 opposite each other and projecting laterally from a central part 27*b*, and further an upward-projecting bearing 29 for slidably receiving guide bar 101 and for engaging a cam element 102 slidably arranged to the guide bar. Both wings 28 have the same design, and the shape of their cross-section is shown by broken hatching representation on FIG. 8. Each wing 28 has a forward-facing concave shaped surface 28*a* designed to enclose partially, i.e. only from behind, the laterally protruding portions 24A" of connecting yoke 24A. The laterally portruding portions 24A" are with their outer parts slidably mounted in slots 25, FIG. 5. This surface 28*a* thus forms an engagement means which from behind is pressed against the connecting yoke 24A. Owing to the engagement of the yoke-shaped connecting means 24A with such concave surfaces 28*a*, nut 27A is prevented from rotating relative to screw spindle 26. This stabilizing function is further aided by the above-mentioned guide bar 101 passing through bearing 29. At both ends 24*a*, connecting yoke 24A is adapted to be pivotally attached as at 24*a* in FIG. 5 to the support arm 36 (FIG. 5) in such a way that it cannot be displaced along said arms. Thus in FIGS. 5 to 10 the linkage means has support means 36 always of fixed length connecting hinge means 35 to connecting means or yoke 24A and the mechanical means includes positioning means or screw spindle 26 and nut 27 and engagement means 29*a* mounted on the casing and connected by engagement to the connecting means like in FIG. 1.

At the outer end of each wing 28 there is a flange 28*b* which is provided, at a distance from concave surface 28*a*, with a hole 28*c* for a pivot pin 117. In both flanks of the central portion 27*b* of the nut there are provided blind holes 28*d*, concentric with holes 28*c* in the flanges 28*b*. A latching mechanism 100*a* more clearly shown in FIG. 10, is mounted in the space between such flanks or planar side faces of the central part 27*b* and the facing planar inner faces of each outer flange 28*b*.

The locking device 100 includes two such latching mechanisms 100*a*, one on each side of central part 27*b*, and a control yoke 105 which bridges screw spindle 26 at the rear of nut 27A, and which has an opening 105*b* at the end of each of its legs 105*a*. Above opening 105*b*, on the front edge of each leg 105*a*, there is provided a shoulder 105*c*, and at the front edge of the central portion of the yoke, and positioned centrally between the two legs 105*a*, is a projection 105*d*.

Each latching mechanism 100*a* includes according to FIG. 10, two identical arms 118, a first hook 111, an elongated second hook 115, a helical tension spring 104 connected between the hooks 111, 115 and three pins 111*a*, 116 and 117 (FIG. 8). The shapes of the arms and hooks are clearly shown in FIG. 10. On the underside of arms 118 there is a recess 119, and it should be noted that the transition at 119*a* from this recess to the angled front edge 118*d* of the arm has a smoothly rounded shape. In the arm 118 are three holes, 118*a*, 118*b* and 118*c* provided respectively for the said three pins 116, 117 and 111*a*.

Hook 115 has a hole 115*a* and a recess 115*b*. The outline of recess 115*b* corresponds to the outline of the protruding portions 24A″ of the connecting yoke 24A. Unlike recess 119 in arm 118, this recess 115*b* ends with a straight section which forms a sharp corner 115*c*. When hook 115 lies between the arms 118 in locking position (FIG. 8), this corner 115*c* projects beyond the smooth curve 119*a* of arms 118. Corner 115*c* ends in an edge 115*c*′ (FIG. 8) which extends tangentially a short distance below the horizontal diameter D of protruding portion 24A″. At the opposite end of hook 115, there is a second sharp corner 115*d* as will be described more fully herebelow.

The two arms 118 enclose between them on the one hand the two hooks 111, 115, secured by means of pins 111*a*, 116, and on the other hand the end of one leg 105*a* of the control yoke 105. Hook 111 is prevented from rotating relative to arms 118 by a further pin 111*b*, whilst hook 115 can pivot as it is mounted only on one pin 116. The entire latching mechanism package fits into the space between the planar lateral surfaces (flanks) of the central part 27*b* of nut 27, and planar surfaces on the inside of the outer flanges 28*b*, and is retained there by means of pivot pin 117, when this pin is inserted in the concentric holes 28*d*, 28*c* and holes 118*b*. A spring 112 on each side of yoke 105 is mounted on anchor 27*c* on nut 27 and engages yoke 105 for forcing or biasing the control yoke to tilt constantly in the direction of arrow C (FIG. 8). As FIG. 8 shows, the recess 119 (FIG. 10) in arm 118 is shaped to clear wing 28. In the space between arms 118 are the hooks 111 and 115 in contact with each other with their facing and corresponding straight edges 111*e*, 115*e*, and carrying together tension spring 104 which rotates hook 115 about pin 116 counterclockwise relative to arm 118 until straight edges 111*e* and 115*e* engage in locking position. Springs 112 engage arms 118 to assist gravity to bias each locking mechanism 100*a* in the direction opposite arrow E to locked position.

Guide bar 101 has a non-circular cross-section, a square cross-section in the example shown, and is supported by bearings 16″, 17″, in such a way that it can rotate about its axis but cannot be axially displaced. Guide bar 101 carries cam element 102 which can be displaced in both directions of arrow B′ (FIG. 9) but which cannot rotate relative to the guide bar. Bearing 29 on central part 27*b* axially carries with it cam element 102 on guide bar 101, and projection 105*d* on control yoke 105 is held continuously in contact with this cam element 102 by the action of springs 112. A forward reverse drive operating fork 103 is fixedly attached to the front end of guide bar 101 which, together with cam element 102, can be rotated by the action of said operating fork 103. As a consequence of such rotation and the shape of the cam element 102, engaging projection 105*d* on control yoke 105, this yoke 105 swings a small amount on pivot pins 117, whereby shoulders 105*c* on control yoke legs 105*a* either block in reverse drive or release in forward drive hooks 115 by respectively engaging or not engaging their corners 115*d*. In FIG. 8 for reverse drive, hook 115 is shown blocked with shoulder 105*c* engaging sharp corner 115*d*.

Between shoulders 105*c* and the control yoke 105 itself, fracture lines 105*e* are provided so that, if the shoulders are unduly stressed, they break off without causing greater damage than the need to fit a new control yoke 105. Such undue stress may occur, for example, when the propeller is put into reverse and the outboard drive strikes an underwater obstacle during the short time for which the boat continues to move a short distance forward even though reverse gear is engaged. An alternative solution to this problem will be explained in greater detail with reference to FIGS. 15 and 16.

Stay bolts 110 (FIG. 8)—two are proposed—extend between rear bearings 16, 16″ and front bearings 17, 17″ (FIG. 7). Screw spindle 26 is protected from dirt etc. by front rubber sealing bellows 26*a*, in FIG. 8 shown extended, and a rear rubber sealing bellows 26*b*, in FIG. 8 shown compressed.

The operation of the apparatus of FIGS. 7–10 is as follows:

When locking device 100 is in locked position, the connection yoke 24A is always engaged from behind by the profiled, i.e. concave-shaped surfaces 28*a* of wings 28, and in this way forward drive propulsion force or power is transmitted for forward motion of the boat. At the front, connection yoke 24A is blocked by the locking device 100*a* in locked position, and more precisely as well by arms 118 and hooks 115. The connecting yoke 24A and the nut 27A are therefore locked together for forward drive.

When in forward drive, and a rearward force on the outboard drive casing opposite to the direction of arrow A comes up which is sufficient to overcome the tension of helical springs 104 (e.g. a tension of 15 kg for each spring), each hook 115, not being blocked by projections 105*c*, is pivoted clockwise, as viewed in FIG. 8, on pin 116 until its first sharp corner 115*c* disappears between curve 119*a* of arms 118, and in this position the entire latching mechanism 100*a* is swung up in the direction of arrow E (FIG. 8) around pivot pins 117, to release locking device 100 so the entire outboard drive can swing upward. This would arise, for example, when the outboard drive in forward motion strikes an underwater obstacle.

When the boat is to be reversed, a gear lever (not shown) is operated in a known manner to a reverse position to reverse the direction of rotation of propeller 11. At the same time, and by means of the same lever-directly or via a linkage such as 44 (FIG. 7) fork means 103 and thereby also guide bar 101 is operated, i.e. rotated into the reverse drive position shown in FIG. 8 when projection 105*d* on the control yoke 105 engages thinnest portion of cam element 102 and is urged into this engagement by spring means 112. In this reverse drive position, the arms 118 and hooks 115 are blocked in locked position by the hooks 115 being engaged by shoulders 105*c* of control yoke 105. After reverse drive operation, on a shift to forward drive the rotation of cam element 102 causes cam element 102 to push projection 105*d* and thereby control yoke 105 in the opposite sense of arrow C, overriding spring means 112 and freeing hooks 115 from shoulders 105*c*.

Thus the locking device 100 possesses two different force response degrees of catch action: absolute locking, break off locking FIG. 8 and high force locking FIGS. 15, 16, as for reversing, and locking that can be overcome by a lower force when the action of the springs 104 is overcome in forward drive, as on impact with an underwater obstacle during forward motion.

FIGS. 11 to 13 show another application of the present invention in an outboard motor 20' FIGS. 11 and 12 show two double-acting hydraulic cylinder-piston assemblies 121–123 and 121'–123', each of which includes a cylinder 121 and 121' and a piston such as 122 (FIG. 11), and which in conventional manner are arranged completely outside the casing 20'A of the outboard motor and supplied by a source of pressurized fluid 39, such as a gear pump, inside the boat. So far, such arrangement defines a conventional trim or lifting position setting device as shown in the above U.S. Pat. No. 4,086,489

According to the present invention, the hydraulic assemblies pivot at their forward ends on steering post 30, and at their rear ends, i.e. in the example shown, at the free rear ends 123*a*, 123'*a* of piston rods 123, 123', the two hydraulic assemblies are interconnected by connecting rod 24 extending right through the entire outboard drive by passing through the elongated slots 25 on either side of casing 20'A to provide support means having positioning means. The rear ends 25*a* of slots 25 define engagement means which engage connecting rod 24 from the rear, and via which at least a part of the propulsive power is transmitted in forward motion. Obviously a special engagement means for connecting rod 24 can be arranged inside casing 20'A, if, for example, this casing were to be considered too weak to transmit the propulsive power.

Within the area 120 shown cross-hatched in FIGS. 12 and 13 are located the power-generating and power-transmitting components of the outboard motor, the detailed design of which lies outside the scope of the present invention.

Connecting rod 24 is conveniently held against engagement means 25*a* with the aid of a locking device 100' which is shown in greater detail in FIG. 14. From FIG. 14 it is apparent that locking device 100' is made up of essentially the same components as catch mechanisms 100*a*. However, instead of control yoke 105, there is a simpler blocking and release mechanism provided, comprising a spring-loaded blocking element 46 arranged to slide in a fixed bearing 45 mounted on casing 20'A, and which by a bar 47 can be operated in both directions of double arrow P. As this drawing shows, in principle a single arm 118 can interact with hook 115, and hook 111 may take the form of an integral part of arm 118. Arm 118 is carried on a shaft 117*a* mounted on casing 21'A and corresponding to pivot pins 117 in FIGS. 8 and 9.

It has already been proposed that cylinder-piston assemblies such as 121–123 and 121'–123', located externally of the casing, should be mounted, instead of on steering post 30, on a separate shaft arranged to turn together with the steering post. The present invention can easily be used also with such a design as shown in FIG. 13. It will be also recognized from FIG. 13 that for the purposes of the present invention, externally located cylinder-piston assemblies may be replaced by externally located nut and spindle screw assemblies. According to FIG. 13, steering post 30 is connected by means of a parallelogram linkage system 130 to a secondary steering post 136 on which two electric motors 14', 14'', possibly fitted with suitable reduction gear mechanisms, not shown, are pivoted. Projecting from each electric motor is a respective screw spindle 26', 26'', each provided with a nut 27', 27''. The nuts 27', 27'' are interconnected by connecting rod 24, and are thus prevented from turning. In other respects the design corresponds to that shown in FIG. 12. The screw spindles, etc., may be enclosed and protected in their appropriate rubber sealing bellows, not shown in FIG. 13 but substantially similar to bellows 26*a*, 26*b* (FIG. 8). Thus in FIGS. 11 to 13 the linkage means has support means having positioning means, cylinder piston assemblies or nut and screw spindle assemblies, and is connected by hinge means 35 to the mounting means and to connecting means 24 which is slidably mounted in the guide means, slot 25 and has mechanical means having engagement means, rear ends 25*a* of slots 25, and locking means 100' engaging connecting means 24.

In connection with FIG. 8, fracture lines 105*e* were mentioned as a form of protection against overloading when reverse gear is engaged. FIGS. 15 and 16 show in connection with FIG. 14 other embodiments to overcome this problem, namely overload catches 106, 106', which are located between hook 115 and blocking element 46' or 46'', respectively.

As FIG. 15 shows, overload catch 106 is mounted on hook 115, and is in the form of a pawl 108 pivoted at 108*a* on hook 115. Pawl 108 engages with blocking element 46', the underside of which is chamfered for easier return motion. Pawl 108 is constantly acted upon by a tension spring 107 mounted on hook 115, and is thus pressed against a stop 108*b*. The tension of spring 107 determines the force at which overload catch 106 is released. In practice it is assumed that when a boat engine at full throttle is shifted into reverse gear, the torque is trebled for a short time. Spring 107 is selected to withstand this force with the motor in question.

As shown in FIG. 16, on the front part of blocking element 46'' there is a pawl 108' pivoting on a pin 46*a* on blocking element 46''. The pawl 108' is pressed against a stop edge 109 by a tension spring 107'. The considerations that applied to tensioning of spring 107, apply equally to spring 107'. It will be understood that the arrangement shown in FIG. 15 or 16 can also be used with control yoke 105, or more precisely hooks 115 in the device shown in FIG. 9, instead of the fracture lines 105*e*.

In all the embodiments shown, remotely-controlled trimming (known as "power trim") is achieved by making the power source for the raising and lowering motion, i.e. in the example shown, electric motors 14, 14', 14'' or pressurized fluid source 39, adjustable to a selected initial position—the trim position—from which additional lifting motion—tipping—can be achieved, but always with return to the same selected initial position. Regardless of whether the energy source as such is electrical (electric motor 14) or hydraulic (cylinder-piston assemblies 21–23, 121–123), the above-mentioned adjustment may conveniently be achieved by operating means 48 having an arrangement of electrical relays (FIGS. 1, 7, 11) that can be operated from the driver's place in the boat.

I claim:

1. An outboard drive, comprising a casing having propulsion means providing a forward force on said casing for forward drive; mounting means adapted for mounting said casing on a boat and having tilt pivot means for pivotally mounting said casing on a tilt axis on said mounting means for downward forward tilt movement to a drive position and for upward rearward tilt movement to tilt position and linkage means connecting said casing to said mounting means at points spaced below said tilt axis for transmitting forward force urging said casing toward said drive position from said casing to said mounting means and permitting said casing to tilt rearwardly in response to a predetermined rearward force to a tilt position and having hinge means on said mounting means with a hinge axis spaced below and parallel to said tilt axis, guide means fixed on said casing and having a front end, a rear end and a longitudinal guide extending from said rear end longitudinally forwardly to said front end closer to said hinge axis and front of said casing all fixed relative to each other and to said casing, connecting means mounted on said guide means for guided longitudinal movement along said fixed longitudinal guide of said guide means between said front end and said rear end, mechanical means connecting said casing to said connecting means and support arm means connected at one end to said connecting means and at the other end to said hinge means for pivotal movement on said mounting means about said hinge axis and said linkage means further including engagement means having an engaged position in response to forward force for transferring forward force from said casing through said linkage means with unvariable length to said mounting means and a disengaged position in response to rearward force for elongation of said linkage means for rearward tilt movement of said casing to a tilt position.

2. The invention defined in claim 1 and said linkage means further comprising positioning means for controllably varying the length of said linkage means for providing tilt movement of said casing to said drive and tilt positions when said engagement means is engaged.

3. The invention defined in claim 1 wherein said propulsion means has forward and reverse drive means and shift control means for selectively providing forward drive and reverse drive respectively providing a forward propulsion force and a reverse propulsion force and said linkage means having locking means operative in locked position for preventing disengagement of said engagement means and for transmitting rearward force with unvariable length of said linkage means and in unlocked position permitting disengage of said engagement means in response to rearward force and having release means controlled by said propulsion means and operative for unlocking said locking means in forward drive in response to a low degree of rearward force and in reverse drive in response to a higher degree of rearward force greater than said rearward propulsion force.

4. The invention defined in claim 1 wherein said support arm means is elongated and said guide means is located in alignment with and up to not greater than a sharp angle with said support means when said connecting means is at said rear end of said guide means.

5. An outboard drive, comprising a casing having propulsion means providing a forward propulsion force on said casing for forward drive mounting means adapted for mounting said casing on a boat having tilt pivot means for mounting said casing for tilt movement about a tilt axis extending transversely between a low drive position and upper rearward tilt positions and said casing being urged by said forward propulsion force forwardly to said drive position and hinge means having a hinge axis spaced below and parallel to said tilt axis; guide means fixed on said casing having fixed relative to each other and relative to said casing, a front end, a rear end and a guide path extending longitudinally from said front end to said rear end located at a greater distance from said hinge axis and front of said casing than said front end; connecting means mounted for guided movement along said guide path of said guide means between said front and rear ends; elongated support means having a front end connected to said hinge means for pivoting about said hinge axis and a rear end connected to said connecting means for pivotal movement relative to said casing; mechanical means for connecting said connecting means and said casing; and said support means and said mechanical means having engagement means mounted on one of said support means and mechanical means operative in response to forward force on said casing for engaging for transmitting only forward force with unvarying length of said support means and mechanical means from said casing to said mounting means and operative in response to rearward force on said casing, for disengaging for elongation of said one of said support means and said mechanical means for tilt movement of said casing from a drive position to tilt positions.

6. The invention defined in claim 5 wherein said mounting means has steering means for providing lateral steering movement of said casing about a vertically extending steer axis, said propulsion means and said hinge axis are spaced below said tilt axis and said tilt axis and said hinge axis are parallel to each other, transverse to said steer axis and follow lateral steering movement of said casing.

7. The invention defined in claim 5 wherein said casing has sidewalls; said guide means has an elongated straight slot in each side wall extending from said rear end to said front end; said connecting means being located and guided in said slots for longitudinal movement between said rear end and said front end and said support means having two elongated rod shaped support means, one located adjacent each side wall of said casing and having their rear ends connected one to the other by said connecting means and their front ends pivotally mounted in spaced relation by said hinge means on said mounting means.

8. The invention defined in claim 7 further comprising buffer means for shock absorption of lateral forces mounted between said casing and said two elongated rod shaped support means.

9. The invention defined in claim 5 further comprising positioning means mounted on and operative for controllably varying the length of one of said support means and said mechanical means for positioning said casing in a selected one of said drive position and tilt positions.

10. The invention defined in claim 9 wherein said support means is elongated and said guide means is located in alignment with and up to not greater than a sharp angle with said support means when said connecting means is at said rear end of said guide means.

11. The invention defined in claim 10 wherein said positioning means is aligned with said guide means.

12. The invention defined in claim 9 wherein said support means is elongated and said guide means and said support means are substantially in the same plane when said connecting means is substantially at said rear end of said guide means.

13. The invention defined in claim 9 wherein said casing has tilt movement to a plurality of adjustable trim drive positions and through tilt positions to clear underwater obstacles to a tilt up position clear of the water, said engagement means while engaged and transmitting forward force in forward drive is responsive to a predetermined rearward force on striking on underwater obstacle to tilt to tilt positions to clear the obstacle and said positioning means is remotely controlled to position and hold said casing in said adjustable trim drive positions and said tilt positions with said engagement means in said engaged position.

14. The invention defined in claim 9 wherein said positioning means is mounted on and operative for controllably varying the length of said mechanical means and said engagement means is mounted on said support means.

15. The invention defined in claim 9 wherein said positioning means is mounted on and operative for controllably varying the length of said support means and said engagement means is mounted on said mechanical means.

16. The invention defined in claim 9 wherein said positioning means is mounted on and operative for controllably varying the length of said mechanical means and said engagement means is mounted on said mechanical means.

17. The invention defined in claim 9 wherein said mechanical means has unvariable length and secures said engagement means stationarily on said casing and said positioning means has remotely controlled power means for adjusting the position of said rear end of said support means relative to said front end for providing tilt movement of said casing to selected drive and tilt positions.

18. The invention defined in claim 9 wherein said casing has spaced side walls, said guide means has a slot in each side wall, said connecting means is mounted in said slots and has a rearwardly facing portion, said support means has two rod members mounted outside said casing and having unvariable length during transmission of force in both directions and said mechanical means has said positioning means with a first part stationarily mounted on and inside said casing and a second part controllably moved on said first part and carrying said engagement means and said second part engaging said rearwardly facing portion for transferring only forward force.

19. The invention defined in claim 9 wherein said positioning means has a cylinder piston assembly of the double acting hydraulic type, power source means providing a source of pressurized fluid and remote control means controlling the supply of pressurized fluid by said power source means to said cylinder piston assembly to control movement to change the length and hold any position of said cylinder piston assembly.

20. The invention defined in claim 9 wherein said positioning means has nut and screw means for varying the length of said positioning means, a power source, a reversible rotary motor connected to said nut and screw means operable to change the length of said nut and screw means and manual control means for controlling the supply from said power source to said reversible rotary motor for controlling said reversible rotary motor for adjusting the length of said nut and screw means.

21. The invention defined in claim 20 wherein said reversible rotary motor is an electric motor, said power source is an electric power source and said manual control means has remote control means at the drivers place and electrical relays for control of said electric motor for positioning and holding said linkage means and said casing in a plurality of tilt positions including trim drive postions and tilt up position clear of the water.

22. The invention defined in claim 20 wherein said casing has spaced side walls, said guide means has an elongated substantially straight slot in each side wall, each slot having a rear end edge, said connecting means being a rod slidably mounted in said slots and said engagement means on said mechanical means being said rear end edges of said slots and contacting portions of said connecting rod.

23. The invention defined in claim 20 wherein said casing has spaced side walls; said guide means has an elongated straight slot in each of said side walls; said nut and screw means having a screw spindle and nut means; said mechanical means rotatably mounting and retaining said screw spindle against axial displacement between said side walls on said casing; said nut means having a centrally located nut threaded on said screw spindle; said rotary motor connected to rotate said screw spindle to axially move said nut means; said connecting means having a connecting yoke with an arch shaped central part bridging said screw spindle and two straight parts, each protruding laterally from an end of said central part, sliding in one of said slots and having front and rear sides; said support means having a rod of fixed length connected to each straight part and said nut means having two wings, each protruding laterally from one of the opposite sides of said nut and having a concave face facing forwardly and engaging said rear side of a straight part for providing said engagement means for transferring forward force and preventing rotation of said nut means.

24. The invention defined in claim 23 further comprising locking means having an arm pivoted on said nut means and having arm edge means for engaging said front side of a straight part, a hook pivoted on said arm and having hook edge means engaging said front side of a straight part and spring release means on said nut means biasing said arm and said hook to locked position for engaging said hook edge means with said front side of a straight part for transmitting a rearward force from said nut means to said connecting means and responsive to a predetermined degree of rearward force overcoming said spring release means to move said hook so said arm edge means engages said front side of a straight part to move said arm and said hook to release position to discontinue transmitting rearward force.

25. The invention defined in claim 24 wherein said spring release means includes second release means and remote control means for providing a first mode of operation responsive to a predetermined low degree of rearward force for releasing said locking means and a second mode of operation responsive to a predetermined higher degree of rearward force for releasing said locking means.

26. The invention defined in claim 25 wherein said nut means has flanges attached to the outer end portions of said wings providing a space between said nut and each flange; a pair of said locking means, one in each of said spaces; common blocking means for both of said locking means having a control yoke with legs straddling said screw spindle, pivoted on said nut means and having a blocking part for blocking each of said hooks in locked position and when said control yoke is in blocking position and releasing said hooks in releasing position; cam means having a guide bar mounted for rotation and retained against axial movement on said casing parallel to said screw spindle and a cam axially slidable on said guide bar and rotable with said guide bar to move said control yoke between blocking position and release position.

27. The invention defined in claim 26 wherein said cam means includes a bearing mounted on said nut means for carrying said cam axially on said guide bar when said nut is axially moved on said screw spindle.

28. The invention defined in claim 27 wherein said blocking part includes overload release means for release of said hook in response to a second predetermined higher degree of reverse force with said control yoke in blocking position.

29. The invention defined in claim 5 wherein said mechanical means includes locking means operative when said engagement means is in engaged position for moving to locked position for locking for transferring rearward force and said locking means having locking control means for controlling releasing movement of said locking means for providing release movement in a first control mode in response to a low degree of rearward force and in a second control mode in response to a higher degree of rearward force.

30. The invention defined in claim 29 wherein said propulsion means also provides a rearward propulsion force on said casing in reverse drive and said locking control means is connected to said propulsion means and controls said locking means for releasing movement in said first control mode in response to a low degree of rearward force in forward drive and said second control mode in response to a higher degree of rearward force greater than said rearward propulsion force.

31. The invention defined in claim 30 wherein said locking means has lever means operative in locked position for transmitting rearward force and is urged by such rearward force to a released position; releasable blocking means controlled by said locking control means to provide a non blocking position and a releasable blocking position respectively in forward drive and reverse drive; spring means biasing said lever means to locked position and in said first mode with said releasable blocking means is in non blocking position, said spring means is overcome by said low degree of rearward force to move said lever means to released position and in said second mode with said releasable blocking means in blocking position said spring means and releasable blocking means are overcome by a higher degree of rearward force to move said lever means to release position.

32. The invention defined in claim 31 wherein said releasable blocking means has a break away part engaging said lever means in blocking position and breaking away in response to said higher degree of rearward force.

33. The invention defined in claim 31 wherein said releasable blocking means has a spring catch engaging said lever means in blocking position and releasing in response to said higher degree of rearward force.

34. The invention defined in claim 5 wherein said casing has spaced sidewalls; said mounting means has steer means for providing lateral steering movement of said casing about a vertically extending steer axis said tilt axis and hinge axis both following said lateral steering movements said forward propulsion force being located below said tilt axis; said guide means having a slot in each side wall; said support means having a pair of rod shaped support means located on opposite sides of said casing; said connecting means having a front side and a rear side and extending through said casing, slidably mounted in said slots and connected at each end to laterally secure a rod shaped support means and said engagement means engaging said rear side of said connecting means for transmitting only forward force and locking means mounted on said mechanical means operative in locked position for engaging said front side of said connecting means for transmitting rearward force and in unlocked position for disengaging to permit free rearward tilt movement of said casing.

35. The invention defined in claim 3 wherein said locking means has a locking lever biased to said locked position and urged by rearward force to said released position and said locking control means has spring means biasing said locking lever to locked position and in forward drive is responsive to said low degree of rearward force for releasing said locking lever and blocking means operative only in reverse drive in blocking position for blocking release of said locking lever and in response to said higher degree of rearward force for releasing said locking lever.

36. The invention defined in claim 35 wherein said blocking means has a break away part engaging said locking lever in reverse drive for blocking release and breaking away in response to said higher degree of rearward force for releasing said locking lever.

37. The invention defined in claim 35 wherein said blocking means has spring catch means for blocking release of said blocking lever in reverse drive and releasing said locking lever in response to said higher degree of rearward force.

38. An outboard drive, comprising a casing having outer walls and propulsion means providing a forward force on said casing for forward drive; mounting means adapted for mounting said casing on a boat and having tilt pivot means for pivotally mounting said casing on a tilt axis on said mounting means for forward tilt movement to a drive position and for upward rearward tilt movement to a tilt position and linkage means connecting said casing to said mounting means at points spaced below said tilt axis for holding said casing in drive position in response to said forward force urging said casing toward said drive position and for transmitting said forward force from said casing to said mounting means and permitting said casing to tilt rearwardly in response to a predetermined rearward force to a tilt position, said linkage means including hinge means on said mounting means with a hinge axis spaced below and parallel to said tilt axis, a pair of elongated parallel support means connected at their forward ends to said hinge means for pivotal movement about said hinge axis with one support means on each side of said casing, connecting means interconnecting transversely through said casing and to said support means at their rear ends and engaging said casing at a controlably longitudinally positionable point of application, engagement means engaging said connecting means at said controlably positionable points of application for providing controlably variable longitudinal distance from the front edge of said casing to said hinge axis of said hinge means and having an engaged position in response to forward force for transferring force from said casing through said linkage means with unvariable length to said mounting means and a disengaged position in response to forward force for elongation of said linkage means for rearward tilt movement of said casing to a tilt position, positioning means for controlled positioning of said point of application on said casing longitudinally between a rear position and a forward position closer to said hinge axis and the front edge of said casing, said outer walls having elongated passage means for said connecting means extending from a rear end forwardly to a front end closer to said hinge axis and allowing unimpeded movement of said connecting means between said two ends.

* * * * *